US005513803A

United States Patent [19]

Czekai et al.

[11] Patent Number: 5,513,803

[45] Date of Patent: May 7, 1996

[54] CONTINUOUS MEDIA RECIRCULATION MILLING PROCESS

[75] Inventors: David A. Czekai, Honeoye Falls; Larry P. Seaman, Mt. Morris, both of N.Y.

[73] Assignee: Eastman Kodak Company, Rochester, N.Y.

[21] Appl. No.: 248,782

[22] Filed: May 25, 1994

[51] Int. Cl.[6] ..... B02C 21/00; B02C 23/36

[52] U.S. Cl. ..... 241/16; 241/22; 241/21

[58] Field of Search ..... 241/5, 21, 16, 241/22, 30, 170–184

[56] References Cited

U.S. PATENT DOCUMENTS

| | | | |
|---|---|---|---|
| 3,104,608 | 9/1963 | Castell et al. | 241/16 |
| 3,713,593 | 1/1973 | Morris et al. | 241/27 |
| 4,056,230 | 11/1977 | Decobert | 241/171 X |
| 4,065,060 | 12/1977 | Booz | 241/171 |
| 4,065,061 | 12/1977 | Bombled | 241/171 X |
| 4,262,851 | 4/1981 | Graser et al. | 241/16 |
| 4,404,346 | 9/1983 | Pirotta et al. | 521/29 |
| 4,474,872 | 10/1984 | Onishi et al. | 430/512 |
| 4,940,654 | 7/1990 | Diehl et al. | 430/522 |
| 4,974,368 | 12/1990 | Miyamoto et al. | 51/55 |
| 5,066,335 | 11/1991 | Lane et al. | 134/7 |
| 5,066,486 | 11/1991 | Kamen et al. | 424/63 |
| 5,145,684 | 9/1992 | Liversidge et al. | 429/489 |
| 5,320,284 | 6/1994 | Nishida et al. | 241/21 |

FOREIGN PATENT DOCUMENTS

| | | | |
|---|---|---|---|
| 247895 | 12/1987 | European Pat. Off. | 241/184 |
| 498482 | 8/1992 | European Pat. Off. . | |
| 273210 | 11/1989 | Germany | 241/184 |
| 580211 | 11/1977 | U.S.S.R. | 241/184 |

OTHER PUBLICATIONS

Drukenbrod, "Smaller Is Better?", Paint & Coatings Industry, Dec. 1991, p. 18.

*Primary Examiner*—Timothy V. Eley
*Attorney, Agent, or Firm*—Andrew J. Anderson

[57] ABSTRACT

A continuous method of preparing submicron particles of a compound useful in imaging elements (or other materials, such as pigments, etc.) comprises the steps of continuously introducing the compound and rigid milling media into a milling chamber, contacting the compound with the milling media while in the chamber to reduce the particle size of the compound, continuously removing the compound and the milling media from the milling chamber, and thereafter separating the compound from the milling media. In a preferred embodiment, the milling media is a polymeric resin having a mean particles size of less than 300 μm. The method enables the use of fine milling media in a continuous milling process which provides extremely fine particles of the compound useful in imaging elements while avoiding problems, e.g., separator screen plugging associated with prior art processes requiring the separation of compound from the milling media in the milling chamber.

14 Claims, 4 Drawing Sheets

CONTINUOUS MEDIA RECIRCULATION MILLING PROCESS

FIELD OF THE INVENTION

This invention relates to a continuous recirculation milling process for obtaining small particles of a material, such as pigments for use in paints and compounds useful in imaging elements.

BACKGROUND OF THE INVENTION

Conventional mills used for size reduction in a continuous mode usually incorporate a means for retaining milling media in the milling zone of the mill (e.g., milling chamber) while allowing passage of the dispersion or slurry through the mill in recirculation to a stirred holding vessel. Various techniques have been established for retaining media in these mills, including rotating gap separators, screens, sieves, centrifugally-assisted screens, and similar devices to physically restrict passage of media from the mill. Over the last ten years there has been a transition to the use of small milling media in conventional media mill processes for the preparation of various paints, pigment dispersions and photographic dispersions. This transition has been made possible due primarily to the improvements in mill designs (eg. Netzsch LMC mills and Drais DCP mills) which allow the use of media as small as 250 μm. The advantages of small media include more efficient comminution (ie. faster rates of size reduction) and smaller ultimate particle sizes. Even with the best machine designs available, it is generally not possible to use media smaller than 250 μm due to separator screen plugging and unacceptable pressure build-up due to hydraulic packing of the media. In fact, for most commercial applications, 350 μm media is considered the practical lower limit for most systems due to media separator screen limitations.

PROBLEMS TO BE SOLVED BY THE INVENTION

We have discovered a continuous milling process for preparing extremely fine particles which avoid various problems, e.g., separator screen plugging and unacceptable pressure build up due to hydraulic packing of the media, associated with prior art processes requiring the separation of the dispersed particles from the milling media in the milling chamber.

SUMMARY OF THE INVENTION

We have found that previous problems of media separation during milling can be avoided by 1) adjustment of media separator to allow passage of media through the separator, and 2) providing a means of continuous recirculation of the media/product mixture throughout the process.

One aspect of this invention comprises a continuous method of preparing submicron particles of a compound useful in imaging elements, said method comprising the steps of:

a) continuously introducing said compound and rigid milling media into a milling chamber, b) contacting said compound with said milling media while in said chamber to reduce the particle size of said compound, c) continuously removing said compound and said milling media from said milling chamber, and thereafter d) separating said compound from said milling media.

Another aspect of this invention comprises a continuous method of preparing submicron particles of a compound useful in imaging, said method comprising the steps of:

a) continuously introducing said compound, rigid milling media and a liquid dispersion medium into a milling chamber, b) wet milling said compound with said milling media while in said chamber to reduce the particle size of said compound, c) continuously removing said compound, said milling media and said liquid dispersion medium from said milling chamber, and thereafter d) separating said compound from said milling media.

During the process of the invention, particles of a compound useful in imaging elements and particles of a rigid milling media are continuously introduced into the mill where milling occurs to reduce the average particle size of the compound and are continuously.

ADVANTAGEOUS EFFECT OF THE INVENTION

A material, such as a compound useful in imaging elements, is milled in a continuous process using small particle milling media to obtain submicron particles.

It is another advantageous feature of this invention that there is provided a milling method which enables the use of ultra-fine milling media, e.g., of a particle size less than 300 μm, in a continuous milling process.

Still another advantageous feature of this invention is that there is provided a continuous milling process which avoids problems, e.g., separator screen plugging, associated with prior art processes requiring the separation of the dispersed compound from the milling media in the milling chamber.

Yet another advantageous feature of this invention is that there is provided a method of fine milling compounds useful in imaging elements, which method generates less heat and reduces potential heat-related problems such as chemical instability and contamination.

DETAILED DESCRIPTION OF THE INVENTION

Figure 1:
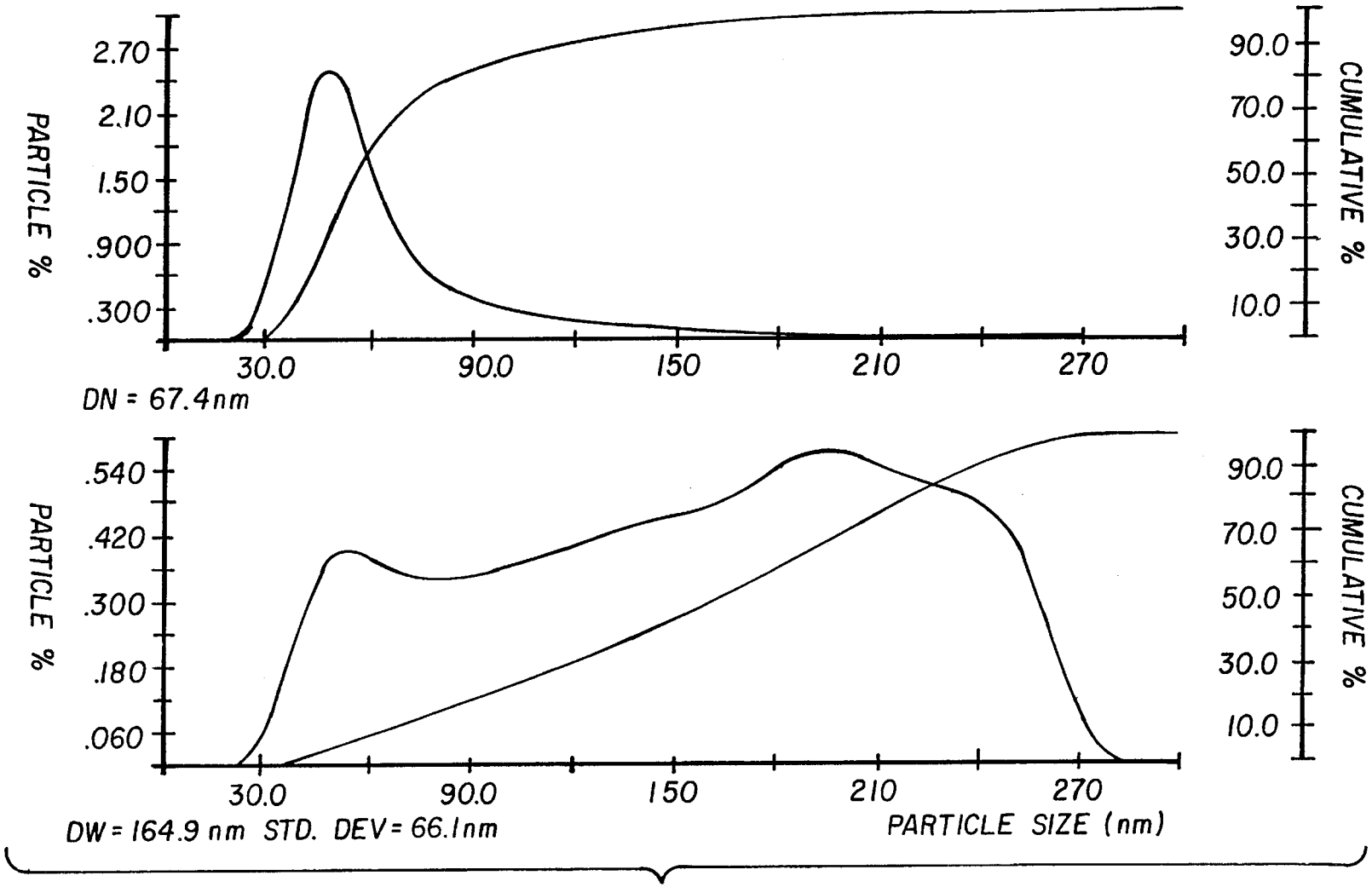
FIGS. 1–3 are graphs presenting the results obtained in the examples set forth below.

This invention is directed to milling materials, such as pigments for paints and compounds useful in imaging elements, to obtain extremely fine particles thereof. By "continuous method" it is meant that both the dispersed compound and the milling media are continuously introduced and removed from the milling chamber. This can be contrasted to a conventional roller mill process wherein the compound to be milled and the milling media are introduced and removed from the milling chamber in a batch process.

The term "compounds useful in imaging elements" refers to compounds that can be used in photographic elements, electrophotographic elements, thermal transfer elements, and the like. While this invention is described primarily in terms of its application to compounds useful in imaging, it is to be understood that the invention can be applied to a wide variety of materials.

In the invention, media is incorporated as an addenda to the dispersion to be milled at a concentration comparable to that which would exist in the milling chamber of a conventional process. Such media concentrations may vary from 10–95% by volume depending on the application and would be selected based on milling performance requirements and the flow characteristics of the combined mixture of media and dispersion.

Media sizes of interest may range from 5 μm to 1000 μm and media separator gaps would be adjusted accordingly to a size approximately 2X–10X the size of the largest media particles present. Media compositions may include glass, ceramics, plastics, steels, etc.

In a preferred embodiment, the milling material can comprise particles, preferably substantially spherical in shape, e.g., beads, consisting essentially of a polymeric resin.

In general, polymeric resins suitable for use herein are chemically and physically inert, substantially free of metals, solvent and monomers, and of sufficient hardness and friability to enable them to avoid being chipped or crushed during milling. Suitable polymeric resins include crosslinked polystyrenes, such as polystyrene crosslinked with divinylbenzene, styrene copolymers, polyacrylates such as polymethyl methylacrylate, polycarbonates, polyacetals, such as Derlin™, vinyl chloride polymers and copolymers, polyurethanes, polyamides, poly(tetrafluoroethylenes), e.g., Teflon™, and other flouropolymers, high density polyethylenes, polypropylenes, cellulose ethers and esters such as cellulose acetate, polyhydroxymethacrylate, polyhydroxyethyl acrylate, silicone containing polymers such as polysiloxanes and the like. The polymer can be biodegradable. Exemplary biodegradable polymers include poly(lactides), poly(glycolids) copolymers of lactides and glycolide, polyanhydrides, poly(hydroxyethyl methacrylate), poly(imino carbonates), poly(N-acylhydroxyproline) esters, poly(N-palmitoyl hydroxyprolino)esters, ethylene-vinyl acetate copolymers, poly(orthoesters), poly(caprolactones), and poly(phosphazenes).

The polymeric resin can have a density from 0.9 to 3.0 g/cm$^3$. Higher density resins are preferred inasmuch as it is believed that these provide more efficient particle size reduction.

Furthermore, Applicants believe that the invention can be practiced in conjunction with various inorganic milling media prepared in the appropriate particle size. Such media include zirconium oxide, such as 95% ZrO stabilized with magnesia, zirconium silicate, glass, stainless steel, titania, alumina, and 95% ZrO stabilized with yttrium.

The media can range in size up to about 100 microns. For fine milling, the particles preferably are less than about 90 microns, more preferably, less than about 75 microns in size and most preferably less that about 50 microns. Excellent particle size reduction has been achieved with media having a particle size of about 25 microns, Media milling with media having a particle size of 5 microns or less is contemplated.

The milling process can be a dry process, e.g., a dry roller milling process, or a wet process, i.e., wet-milling. In preferred embodiments, this invention is practiced in accordance with the wet-milling process described in U.S. Pat. No. 5,145,684 and European Patent Application 498,492, the disclosures of which are incorporated herein by reference. Thus, the wet milling process can be practiced in conjunction with a liquid dispersion medium and surface modifier such as described in these publications. Useful liquid dispersion media include water, aqueous salt solutions, ethanol, butanol, hexane, glycol and the like. The surface modifier can be selected from known organic and inorganic materials such as described in these publications. The surface modifier can be present in an amount 0.1–90%, preferably 1–80% by weight based on the total weight of the dry particles.

In preferred embodiments, the compound useful in imaging elements can be prepared in submicron or nanoparticulate particle size, e.g., less than about 500 nm. Applicants have demonstrated that particles having an average particle size of less than 100 nm have been prepared in accordance with the present invention. It was particularly surprising and unexpected that such fine particles could be prepared free of unacceptable contamination.

Milling can take place in any suitable milling mill. Suitable mills include an airjet mill, a roller mill, a ball mill, an attritor mill, a vibratory mill, a planetary mill, a sand mill and a bead mill. A high energy media mill is preferred when the milling media consists essentially of the polymeric resin. The mill can contain a rotating shaft. This invention can also be practiced in conjunction with high speed dispersers such as a Cowles disperser, rotor-stator mixers, or other conventional mixers which can deliver high fluid velocity and high shear.

The preferred proportions of the milling media, the compound useful in imaging, the optional liquid dispersion medium and surface modifier can vary within wide limits and depends, for example, upon the particular material selected, the size and density of the milling media, the type of mill selected, etc. Milling media concentrations can range from about 10–95%, preferably 20–90% by volume depending on the application and can be optimized based on milling performance requirements, and the flow characteristics of the combined milling media and compound to be milled.

The attrition time can vary widely and depends primarily on the compound useful in imaging elements, mechanical means and residence conditions selected, the initial and desired final particle size and so forth. Residence time of less than about 8 hours are generally required using high energy dispersers and or media mills.

The process can be carried out within a wide range of temperatures and pressures. The process preferably is carried out at t temperature which should cause the compound useful in imaging to degrade. Generally, temperatures of less than about 30° C. –40° C. are preferred. Control of the temperature, e.g., by jacketing or immersion of the milling chamber in ice water are contemplated.

The process can be practiced with a wide variety of materials, in particular pigments useful in paints and especially compounds useful in imaging elements. In the case of dry milling the compound useful in imaging elements should be capable of being formed into solid particles. In the case of wet milling the compound useful in imaging elements should be poorly soluble and dispersible in at least one liquid medium. By "poorly soluble", it is meant that the compound useful in imaging elements has a solubility in the liquid dispersion medium, e.g., water, of less that about 10 mg/ml, and preferably of less than about 1 mg/ml. The preferred liquid dispersion medium is water. Additionally, the invention can be practiced with other liquid media.

In preferred embodiments of the invention the compound useful in imaging elements is dispersed in water and the resulting dispersion is used in the preparation of the imaging element. The liquid dispersion medium comprises water and a surfactant. The surfactant used can be, for example, a polymeric dispersing aid and other surfactants described in copending applications Ser. Nos. 228,839, 228,971, and 229,267 all filed on Apr. 18, 1994, the disclosures of which are incorporated herein by reference.

The compound useful in imaging elements and the milling media are continuously removed from the milling chamber. Thereafter, the milling media is separated from the milled particulate compound useful in imaging elements using conventional separation techniques, in a secondary process such as by simple filtration, sieving through a mesh filter screen, and the like. Other separation techniques such as centrifugation may also be employed.

Suitable compounds useful in imaging elements include for example, dye-forming couplers, development inhibitor release couplers (DIR's), development inhibitor anchimeric release couplers (DI(A)R's), masking couplers, filter dyes, thermal transfer dyes, optical brighteners, nucleators, development accelerators, oxidized developer scavengers, ultraviolet radiation absorbing compounds, sensitizing dyes, development inhibitors, antifoggants, bleach accelerators, magnetic particles, lubricants, matting agents, etc.

Examples of such compounds can be found in Research Disclosure, December 1989, Item 308,119 published by Kenneth Mason Publications, Ltd., Dudley Annex, 12a North Street, Emsworth, Hampshire P010 7DQ, England, Sections VII and VIII, which are incorporated herein by reference, and in Research Disclosure, November 1992, Item 34390 also published by Kenneth Mason Publications and incorporated herein by reference.

Preferred compounds useful in imaging elements that can be used in dispersions in accordance with this invention are filter dyes, thermal transfer dyes, and sensitizing dyes, such as those described below.

D-1

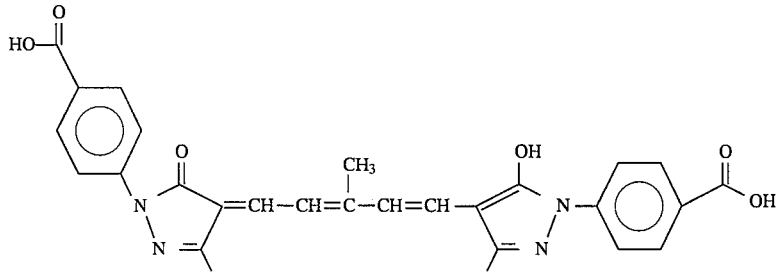

D-2

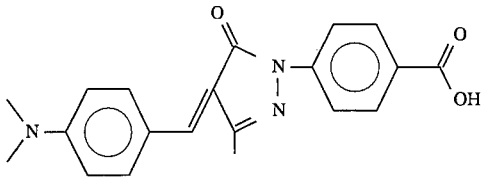

D-3

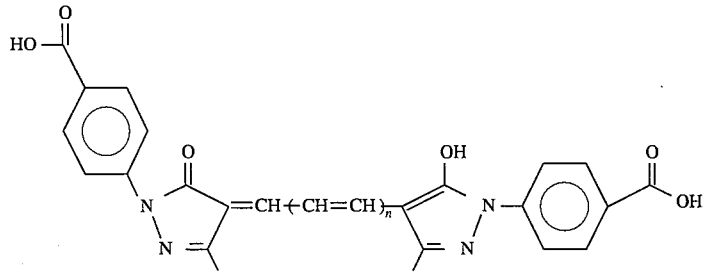

(n = 0)

D-4

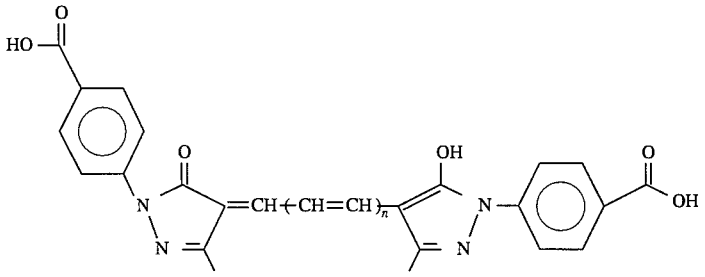

(n = 1)

-continued
D-5
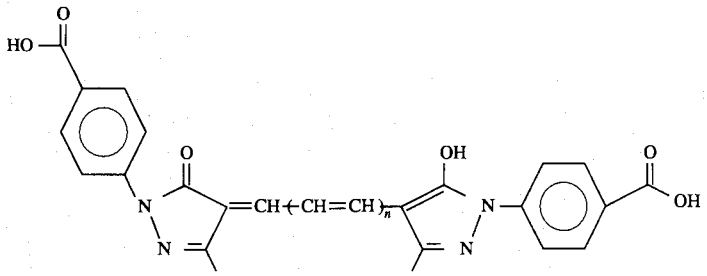
(n = 2)
D-6
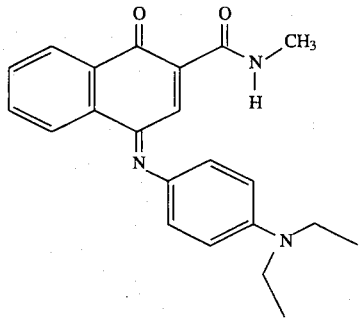
D-7
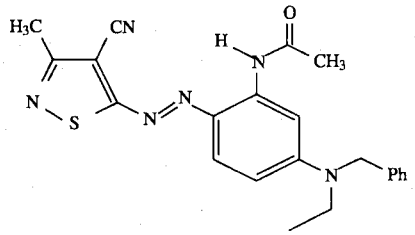
D-8
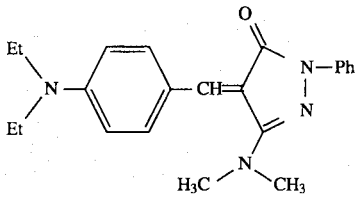
D-9
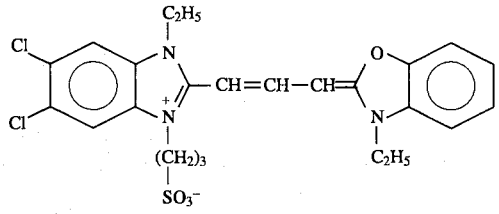
D-10
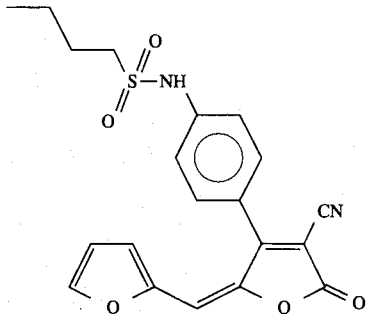

-continued
D-11
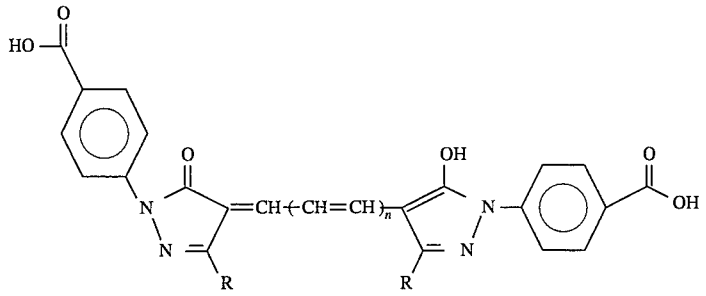
n = 0–2, R = C2–C10 alkyl, aryl
D-12
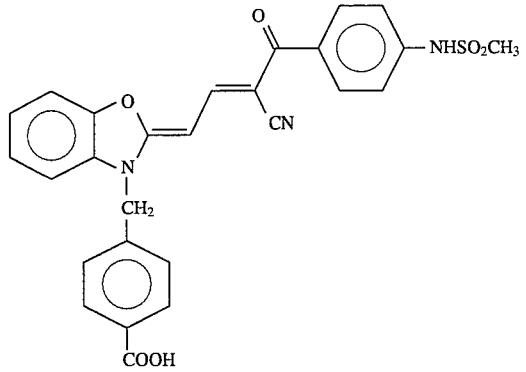
D-13
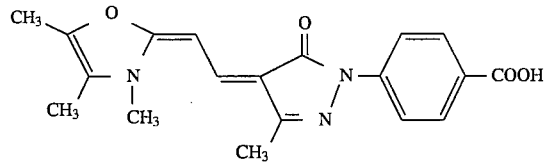
D-14
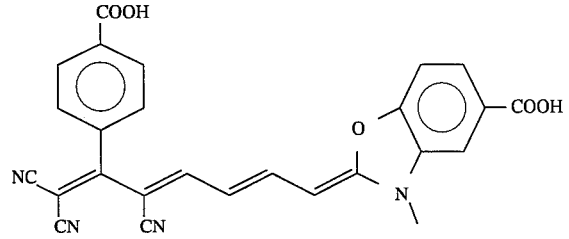
D-15
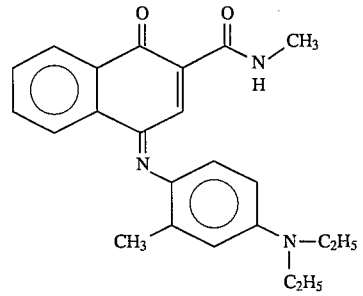
D-16
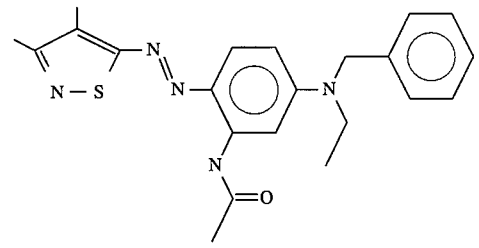

-continued

D-17

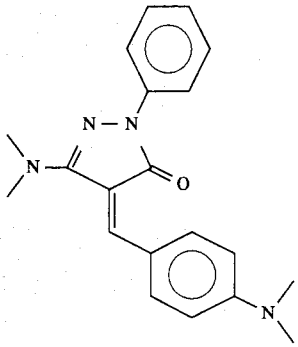

D-18

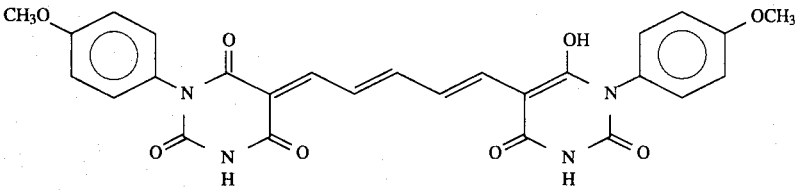

It is to be understood that this list is representative only, and not meant to be exclusive. In particularly preferred embodiments of the invention, the compound useful in imaging elements is a sensitizing dye, thermal transfer dye or filter dye.

In general, filter dyes that can be used in accordance with this invention are those described in European patent applications EP 549,089 of Texter et al, and EP 430,180 and U.S. Patents Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179; and 5,266,454; (the disclosures of which are incorporated herein by reference).

In general, thermal transfer dyes that can be used in accordance with this invention include anthraquinone dyes, e.g., Sumikaron Violet RS® (product of Sumitomo Chemical Co., Ltd.), Dianix Fast Violet 3RFS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd.), and Aizen Malachite Green® (product of Hodogaya Chemical Co., Ltd.); or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference.

In general, sensitizing dyes that can be used in accordance with this invention include cyanine dyes, merocyanine dyes, complex cyanine dyes, complex merocyanine dyes, homopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes and the complex merocyanine dyes that can be employed contain 5- or 6-membered heterocyclic nuclei such as pyrazolin-5-one nucleus, a thiohydantoin nucleus, a 2-thioxazolidin-2,4-dione nucleus, a thiazolidine-2,4-dione nucleus, a rhodanine nucleus, a thiobarbituric acid nucleus, and the like.

Solid particle dispersions of sensitizing dyes may be added to a silver halide emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No, 3,743,510), cadmium salts, azaindene compounds, and the like, can be present.

The sensitizing dye may be added to an emulsion comprising silver halide grains and, typically, a hydrophilic colloid at any time prior to (e.g., during or after chemical sensitization) or simultaneous with the coating of the emulsion on a photographic support). The dye/silver halide emulsion may be mixed with a dispersion of color image-forming coupler immediately before coating or in advance of coating (for example, 2 hours). The above-described sensitizing dyes can be used individually, or may be used in combination, e.g. to also provide the silver halide with additional sensitivity to wavelengths of light outside that provided by one dye or to supersensitize the silver halide.

In a preferred embodiment, the compound to be milled and milling media are recirculated through the milling chamber. Examples of suitable means to effect such recirculated through the milling chamber. Examples of suitable means to effect such recirculation include conventional pumps such as peristaltic pumps, diaphragm pumps, piston pumps, centrifugal pumps and other positive displacement pumps which do not use sufficiently close tolerances to damage the milling media. Peristaltic pumps are generally preferred.

Another variation of this process includes the use of mixed media sizes. For example, larger media may be employed in a conventional manner where such media is restricted to the milling chamber. Smaller milling media may be continuously recirculated through the system and permitted to pass through the agitated bed of larger milling media. In this embodiment, the smaller media is preferably between about 1 and 300 μm in mean particle and the larger milling media is between about 300 and 1000μm in mean particle size.

Figure 4:
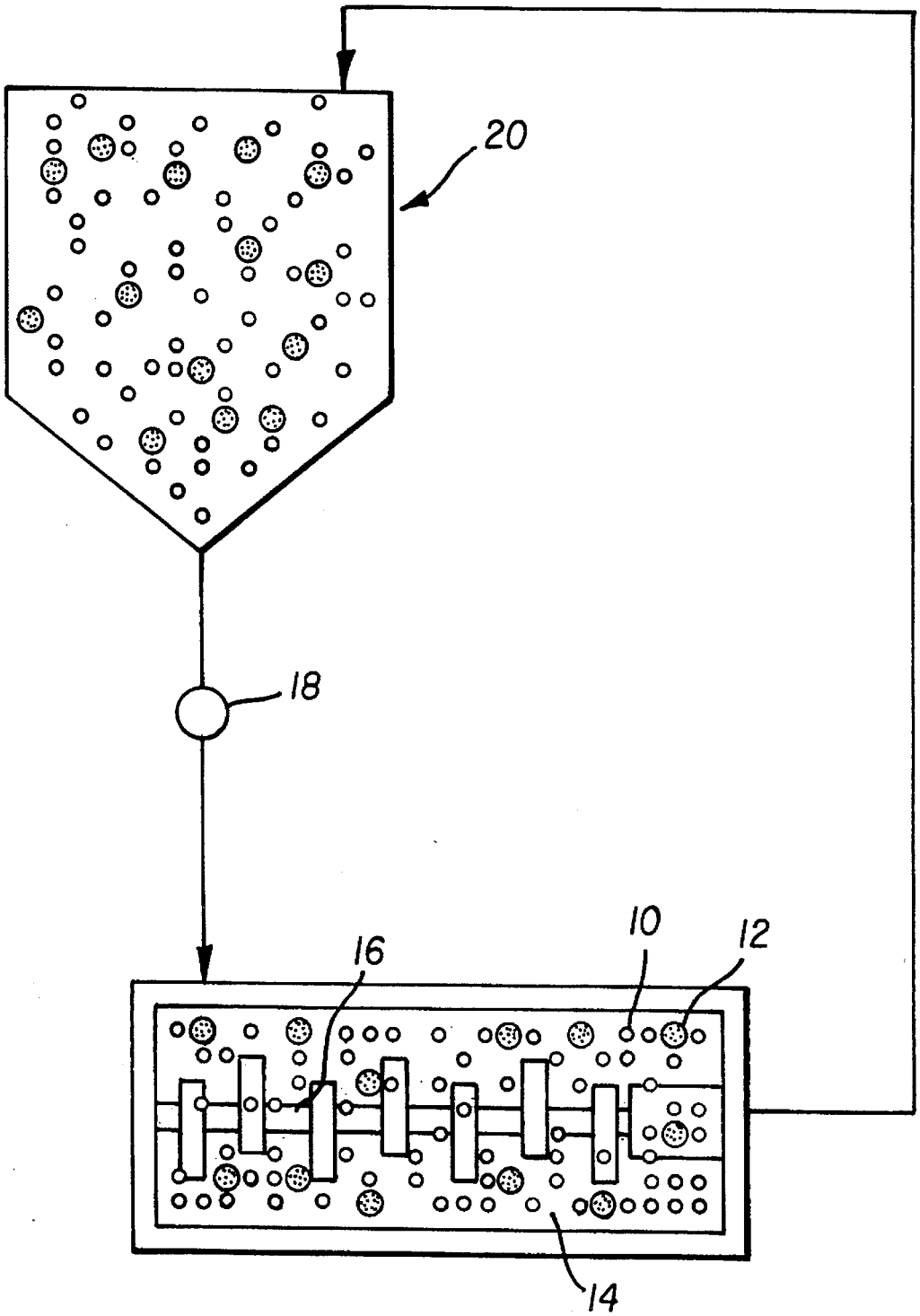
FIG. 4 is a schematic view of a preferred embodiment of a continuous milling process in accordance with this invention.

With reference to FIG. 4, the process of this invention can be carried out as follows. The compound useful in imaging elements 10 and rigid milling media 12 are continuously introduced into milling chamber 14 which, as illustrated, contains rotating shaft 16. Peristaltic pump 18 provides the energy to recirculate the dispersion containing both the compound and milling media through the milling chamber to holding tank 20. As opposed to conventional prior art process, there is no means for retaining the milling media within the milling chamber, such as a screen or rotating gap separator.

The following examples illustrate the process of this invention.

EXAMPLE 1

An aqueous premix slurry of a yellow filter dye was prepared by combining the following ingredients with simple mixing:

| component | Amount (g) |
|---|---|
| Dye | 30 |
| Triton X-200 (surfactant) | 3 |
| Polyvinyl pyrolidone (mw –37,000) | 4.5 |
| Water | 562.5 |
| Total | 600 |

The dye used has the structural formula:

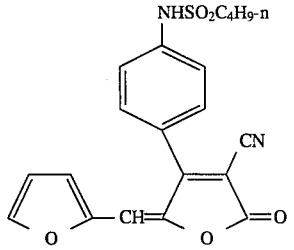

This slurry was combined with 750 g of polystyrene milling media of an average diameter of 50 μm. The combined mixture of filter dye slurry and media was processed in a 0.6 liter Dyno Mill (Chicago Boiler Company, Buffalo Grove, Ill.) media mill at 3000 rpm for 60 minutes residence time. This processing included continuously recirculating the mixture from a stirred holding vessel through the media mill by means of a peristaltic pump at 100 g/min flow rate. The media separator gap in the media mill, which is normally adjusted to restrict the media to the milling chamber, was adjusted to 500 μm clearance to allow free passage of the media from the chamber back to the holding vessel. This configuration ensured no significant accumulation of media within the milling chamber. A mixture ratio of media:slurry of 1.25 was maintained throughout processing. A processing temperature of 20° C.±5° C. was maintained.

After 60 minutes residence time, the milled slurry was separated from the milling media using an 8 μm filter. Samples of the unmilled premix slurry and milled slurry were characterized for particle size distribution by Capillary Hydrodynamic Fractionation (Matec Applied Sciences, 75 House Street, Hopkinton, Mass., 01748) using a high resolution capillary cartridge Serial #208 and eluted with a 10 wt % dilution GR-500 aqueous eluent.

Figure 2:
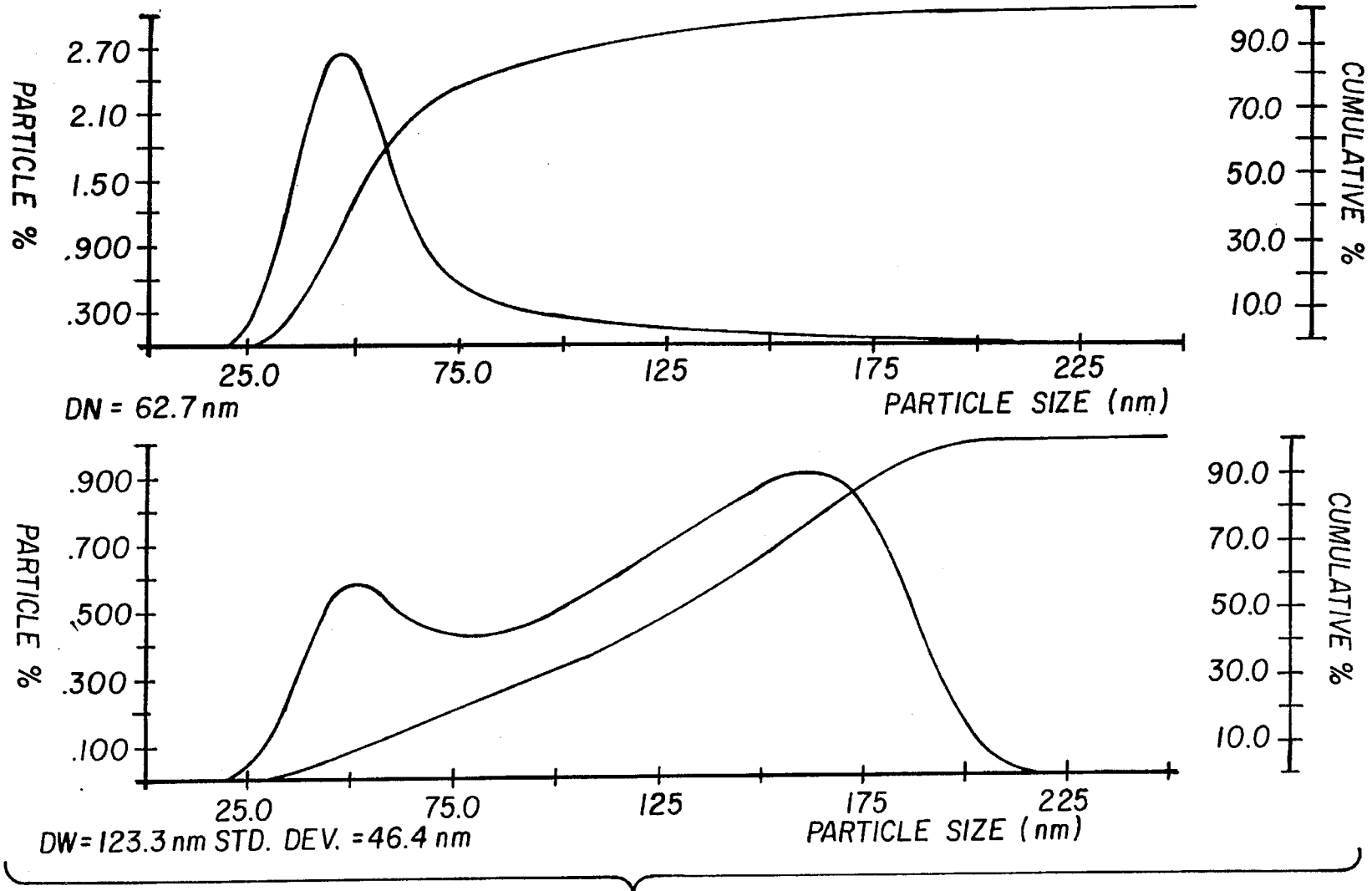

FIGS. 1 and 2 compare the particle size number and weight distributions for the unmilled premix and milled slurry, respectively. The following table compares the weight average particle diameters for each variation:

| Sample | mean diameter (nm) |
|---|---|
| 1-1 unmilled premix | 164.9 |
| 1-2 milled slurry | 123.3 |

As shown, processing with 50 μm media in a continuous media recirculation process resulted in a significant reduction in the average particle diameter and reduced the number of unwanted particles larger than 200 nm.

EXAMPLE 2

Figure 3:
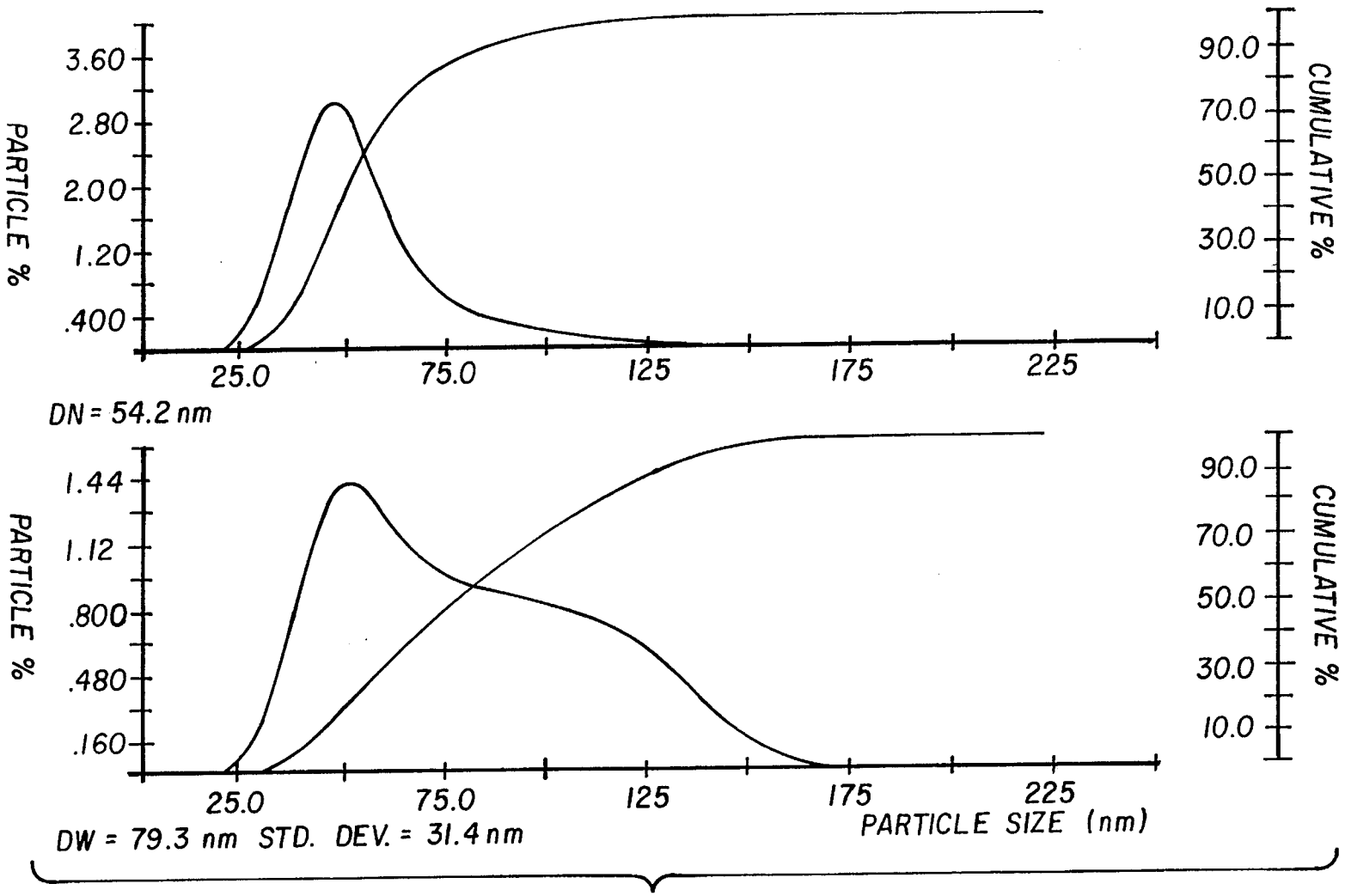

A second premix slurry of the same yellow filter dye was prepared as in Example 1. 600 g of this slurry was combined with 1170 g of 75 μm mean diameter polymethyl methacrylate milling media. This mixture was processed as in Example 1 and the particle size distributions of both the premix slurry and milled slurry were measured. The attached FIG. 3 shows the particle size number and weight distributions for the milled slurry relative to the unmilled slurry in FIG. 1. The following table compares the weight average particle diameters for each variation:

| sample | mean diameter (μm) |
|---|---|
| 2-1 unmilled premix | 164.9 |
| 2-2 milled slurry | 79.3 |

These data confirm that media of a different size and composition used in the process described in Example 1 may be used to achieve large reduction in mean particle diameter.

EXAMPLE 3

An aqueous premix slurry of a yellow filter dye was prepared by combining the following ingredients with simple mixing:

| Component | Amount (g) |
|---|---|
| Dye | 40 |
| Oleoylmethyltaurine, sodium salt | 8 |
| Water | 752 |
| Total | 800 |

The dye used in this example has the following structural formula:

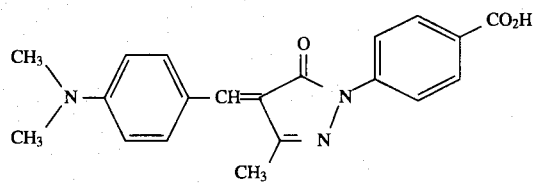

The filter dye slurry was processed in a 0.6 liter Dyno Mill media mill at 3000 rpm for 60 minutes residence time. The media mill chamber was charged with 0.48 liters of 500 μm polystyrene milling media, and the media separator gap was adjusted to 100 μm to retain the media in the mill during processing. Processing included continuously recirculating the slurry from a stirred holding vessel through the media mill by means of a peristaltic pump at 100 g/min flow rate. A processing temperature of 20C±5C was maintained during milling. 10g samples were removed during milling at 10, 20, 40, and 60 minutes residence time and were characterized for particle size distribution as in Example 1.

After 60 minutes residence time, 200 g of 50 μm polystyrene milling media was added to the slurry while in recirculation through the media mill. The 50 μm media were of sufficiently small size to allow passage through the agitated bed of 500 μm media in the mill chamber and through the 100 μm media separator gap. In this way milling was accomplished by both the larger 500 μm media and smaller 50 μm in the milling chamber. Samples were removed at 80, 100 and 120 minutes residence time during this stage of milling, and the 50 μm media was removed using an 8 μm filter. The samples were characterized as before.

| Sample | Residence time (min) | media size (μm) | mean diameter (nm) |
|---|---|---|---|
| 3-1 | 10 | 500 | 277.1 |
| 3-2 | 20 | 500 | 208.1 |
| 3-3 | 40 | 500 | 206.3 |
| 3-4 | 60 | 500 | 191.3 |
| 3-5 | 80 | 50 + 500 | 156.5 |
| 3-6 | 100 | 50 + 500 | 136.9 |
| 3-7 | 120 | 50 + 500 | 124.4 |

After the addition of 50 mm media to the system, there is further particle size reduction to a very small mean diameter. There was no evidence of erosion or fracture of the smaller media by the larger media after processing.

EXAMPLE 4

Another aqueous premix slurry of the same yellow filter dye used in Example 3 was prepared by combining the following ingredients with simple mixing:

| Component | Amount (g) |
|---|---|
| Dye | 50 |
| Oleoylmethyltaurine, sodium salt | 10 |
| Water | 440 |
| Total | 500 |

This slurry was combined with 625 g of polystryene milling media of an average diameter of 50 μm. The combined mixture of filter dye slurry and media was processed in a 0.6 liter Dyno Mill as in Example 1 for 120 minutes residence time, and samples were removed at 20, 40, 60 and 120 minutes for characterization as before.

| residence time (min) | mean diameter (nm) |
|---|---|
| 20 | 245.4 |
| 40 | 196.1 |
| 60 | 174.4 |
| 120 | 127.3 |

These data confirm that the process described in Example 1 may be applicable to materials of other compositions and be an effective means of particle size reduction for such materials.

The invention has been described in detail with particular reference to certain preferred embodiments thereof, but it will be understood that variations and modifications can be effected within the spirit and scope of the invention.

What is claimed is:

1. A continuous method of preparing submicron particles of a compound useful in imaging elements, said method comprising the steps of:

a) continuously introducing said compound and rigid milling media having a mean particle size of less than 300 μm into a milling chamber, b) contacting said compound with said milling media while in said chamber to reduce the particle size of said compound to a submicron size, c) continuously removing said compound and said milling media from said milling chamber, and thereafter d) separating said compound from said milling media.

2. The method of claim 1, wherein said media have a mean particle size of less than 100 μm.

3. The method of claim 1, wherein said media have a mean particle size of less than 90 μm.

4. The method of claim 1, wherein said media have a mean particle size of less than 25 μm.

5. The method of claim 1, wherein said milling media are beads of a polymeric resin.

6. The method of claim 5, wherein said polymer is polystyrene crosslinked with divinylbenzene.

7. The method of claim 5, wherein said polymer is polymethacrylate.

8. The method of claim 1, wherein said compound useful in imaging elements is a dye-forming coupler, development inhibitor release coupler, development inhibitor anchimeric release coupler, masking coupler, filter dye, optical brightener, nucleator, development accelerator, oxidized developer scavenger, ultraviolet radiation absorbing compound, sensitizing dye, development inhibitor, antifoggant, bleach accelerator, magnetic particle, lubricant, or matting agent.

9. The method of claim 1, further including the step of recirculating said compound and said milling media through said milling chamber.

10. The method of claim 1, wherein said milling chamber includes a rotating shaft.

11. A continuous method of preparing submicron particles of a compound useful in imaging, said method comprising the steps of:

a) continuously introducing said compound, rigid milling media having a mean particle size of less than 300 μm and a liquid dispersion medium into a milling chamber, b) wet milling said compound with said milling media while in said chamber to reduce the particle size of said compound to a submicron size, c) continuously removing said compound, said milling media and said liquid dispersion medium from said milling chamber, and thereafter d) separating said compound from said milling media.

12. The method of claim 1, wherein said media have a mean particle size of less than 75 μm.

13. The method of claim 1, wherein said media have a mean particle size of less than 50 μm.

14. The method of claim 11, wherein large milling media of mean particle size between 300 and 1000 μm is retained in the milling chamber while said milling media having a mean particle size of less than 300 μm is continuously recirculated through the milling chamber.

* * * * *